US006475690B2

(12) United States Patent
Anno et al.

(10) Patent No.: US 6,475,690 B2
(45) Date of Patent: Nov. 5, 2002

(54) TONER FOR DEVELOPING AN ELECTROSTATIC IMAGE

(75) Inventors: Masahiro Anno, Sakai (JP); Tetsuo Sano, Amagasaki (JP); Kenichi Kido, Nishinomiya (JP); Hiroyuki Fukuda, Sanda (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/923,349

(22) Filed: Aug. 8, 2001

(65) Prior Publication Data

US 2002/0042011 A1 Apr. 11, 2002

(30) Foreign Application Priority Data

Aug. 9, 2000 (JP) ..... 2000-241109

(51) Int. Cl.[7] ..... G03G 9/097

(52) U.S. Cl. ..... 430/108.8; 430/108.1; 430/110.1; 430/111.4

(58) Field of Search ..... 430/110.2, 110.1, 430/109.3, 109.4, 108.8, 108.1, 108.4, 111.4

(56) References Cited

U.S. PATENT DOCUMENTS 5,614,347 A 3/1997 Aoki et al.
5,714,294 A * 2/1998 Maruta et al. ..... 430/109.3
5,958,642 A 9/1999 Takagi et al.
5,972,547 A 10/1999 Yaguchi et al.
H1889 H * 10/2000 Lin et al. ..... 430/108.8

FOREIGN PATENT DOCUMENTS

JP 4-257868 9/1992

* cited by examiner

*Primary Examiner*—Janis L. Dote
(74) *Attorney, Agent, or Firm*—Burns, Doane, Swecker & Mathis, LLP

(57) ABSTRACT

A toner is provided for developing an electrostatic image which has relatively high roundness, uniform shape, excellent property of electrification, electrification stability, maintenance of heat resistance, fixability, image quality and productivity, and is effective for full-color image formation, cleanerless system and toner-recycling system. The toner comprises toner particles containing a binder resin (A), a polymer (B) and a colorant, the polymer (B) having weight-average molecular weight of 1000–3000 and a ratio of weight-average molecular weight/number-average molecular weight of not more than 2.0, wherein the polymer (B) particles exist on surfaces of the toner particles.

20 Claims, No Drawings

TONER FOR DEVELOPING AN ELECTROSTATIC IMAGE

This application is based on an application No. 241109/2000 filed in Japan, the contents of which are hereby incorporated by reference.

BACKGROUND OF THE INVENTION

1. Field of the invention

The present invention relates to a toner for developing an electrostatic image which may be employed in printers and copying machines wherein an electrophotographic mode, an electrostatic printing mode and the like are adopted.

2. Description of the Related Art

The toner for developing an electrostatic image is generally prepared by a grinding method from a viewpoint of easy preparation. The grinding method is a method wherein at least a binder resin and a colorant are melted, kneaded, cooled, coarsely ground, finely ground and then classified if necessary to obtain toner particles having desired particle size. However, it has been difficult to efficiently prepare small-size toner particles by employing said grinding method in order to satisfy the requirement of recent tendencies of a full-colorization and a high image quality. Although it has been known that a grindability of a toner composition is increased when what is called a grinding agent (a resin which is more brittle than the binder resin) is added to the toner composition before grinding, there is a problem that said grinding agent exerts a bad influence upon basic properties of the toner, such as electrification, heat resistance, fixability and the like.

Accordingly various techniques have been disclosed, such as a technique wherein $C_7$–$C_{10}$ aromatic petroleum resin is added to binder resins, such as styrene-butadiene resin and the like (Japanese Patent Publication (KOKAI) No. 257868/1992), a technique wherein a hydrogenated petroleum resin whose hydrogenation degree is not less than 50% is added to binder resins (U.S. Pat. No. 5,614,347), a technique wherein a copolymer comprising styrene monomer and indene monomer is added to binder resins (U.S. Pat. No. 5,972,547) and a technique wherein a copolymer comprising aliphatic hydrocarbon and aromatic hydrocarbon having carbon atoms of not less than 9 is added to binder resins (U.S. Pat. No. 5,958,642).

However, the aforementioned techniques could not sufficiently prevent the decrease of the aforesaid basic properties of the toner. Particularly, when the toners according to the aforementioned techniques are employed, an electrification stability is remarkably decreased because toner particles are broken at the time of wearing, and pieces of the broken particles are adhered to the various members and stuck to carriers. Furthermore, although the toner compositions according to the aforementioned techniques are easy to grind, there is a problem of productivity (yield) of the toner that it is difficult to effectively obtain the toner particles having a desired particle size since fine particles and large-size particles are easy to form.

SUMMARY OF THE INVENTION

The present invention has been made in view of the aforementioned situation. The object of the present invention is to provide a toner for developing an electrostatic image which has excellent rising property of electrification, electrification stability, maintenance of heat resistance, fixability, image quality and productivity.

Another object of the present invention is to provide a toner for developing an electrostatic image which has relatively high roundness and uniform shape, said toner being applied to full-color image formation, cleanerless system and toner-recycling system.

The present invention relates to a toner for developing an electrostatic image characterized in that it comprises toner particles containing a binder resin (A), a polymer (B) and colorant, the polymer (B) having a weight-average molecular weight of 1000–3000 and having a ratio of weight-average molecular weight/number-average molecular weight being not more than 2.0, wherein the polymer (B) particles exists on surfaces of the toner particles.

DETAILED DESCRIPTION OF THE INVENTION

In the toner particles which constitute the toner of the present invention, at least the colorant and the polymer (B) are dispersed into the binder resin (A). Particularly, the toner particles have a construction wherein the polymer (B) is more densely dispersed in surface regions of said particles in comparison with central parts of said particles. Preferably, the polymer (B) is exposed on the surfaces of the toner particles.

In the present invention, the productivity of the toner can be increased without decreasing the basic properties, such as rising property of electrification, electrification stability, maintenance of heat resistance, fixability, image quality and the like by realizing the aforesaid construction of the toner particles.

The effect of the present invention cannot be obtained when the polymer (B) is not densely dispersed in the surface regions of the toner particles in comparison with the central parts of said particles, i.e. when the polymer (B) is uniformly dispersed in the toner particles or is densely dispersed in the central parts of said particles. That is to say, if the toner particles have these constructions, it is difficult to obtain a desired electrification amount from an early stage and a fogging occurs remarkably at the time of wearing since the toner particles are easy to break to form their broken pieces which stick to various kinds of blades and carriers. Furthermore, these toner particles have a bad grindability during their preparation process and a large amount of energy is required to obtain the toner particles having a desired particle size. On this occasion, a portion of the toner particles is overground to increase fine particles having smaller particle size than the desired particle size, and on the contrary, large-size particles are easy to mix with the desired toner particles. Consequently, a particle size distribution of the ground toner particles becomes broad, and a yield of the toner is decreased.

The fact that the toner particles which constitute the toner of the present invention have the construction wherein the polymer (B) is more densely dispersed in the surface regions of the toner particles in comparison with the central parts of the toner particles can easily be understood by the following knowledges:

(1) When a slice of the obtained toner particles was observed by means of TEM (transmission electron microscopy; 10000 magnifications), the polymer (B) was more densely dispersed in the surface regions of the toner particles in comparison with the central parts of the toner particles.

(2) Even if the glass transition point (Tg) of the binder resin (A) to be used is relatively low, a decrease of the maintenance of heat resistance was effectively suppressed when the polymer (B) having a relatively high Tg was employed.

The toner having the aforementioned construction of the present invention can be prepared by dispersing a suitable amount of the polymer (B) having a suitable particle size and higher grindability than the binder resin (A) in said binder resin. More particularly, the toner according to the present invention can be obtained by employing a grinding method and by controlling the grindabilities of the binder resin (A) and polymer (B) as well as the dispersed state of the polymer (B) in the kneaded mixture which is obtained by cooling the molten kneaded mixture.

As regards the polymer (B) employed in the present invention, a weight-average molecular weight (Mw) is 1000–3000, preferably 1000–2800, and a ratio of Mw/Mn (wherein Mn is a number-average molecular weight) is not more than 2.0, preferably not more than 1.9. When Mw of the polymer (B) is less than 1000, not only the toner particles cannot be obtained wherein the polymer (B) is densely dispersed in the surface regions of the toner particles, but also the maintenance of heat resistance becomes worse when the toner is left at relatively high temperature and a practical use becomes difficult since the glass transition temperature of the polymer (B) is decreased. In addition, volatile components, such as acetone, benzene, monomers and the like are apt to remain in said polymer, and the problems concerning a security and an offensive smell are brought about since said volatile components are volatilized at the time of toner production and image formation, i.e. the total volatile organic components (VOC) in the polymer (B) exceeds 1000 ppm, and it is difficult to practically use the toner. On the other hand, when Mw of the polymer (B) is more than 3000, a grindability of said material itself becomes worse, and a increasing effect of the grindability by employing said material cannot be obtained. In addition, a light transmittance for OHP becomes worse when the toner is used as a color toner since a particle size of the polymer (B) dispersed in the toner particles becomes relatively large. Furthermore, a desired grindability cannot be maintained, and a grinded surface is formed as an ununiform surface since the polymer (B) becomes not dense. For this reason, an electrifiability of the toner becomes worse, and a stress resistance of the toner is decreased, and an adhesion of the toner occurs when it is evaluated as one component.

The values of Mw and Mn of the polymer or resin used in the present specification are those measured by means of gel permeation chromatography 807-IT type (manufactured by Jasco Corporation).

The polymer (B) has desirably a grindability index of 0.1–1.0, preferably 0.2–0.6. The grindability index is an index which indicates an easiness of grinding. The less said index is, the easier the sample is ground.

The grindability indices used in the present specification are measured by the following method. At the time when a sample whose volume-average particle size is about 2 mm is ground by means of a mechanical grinder KTM-0 type (manufactured by Kawasaki Heavy Industries Ltd.) under the condition that the treating rate (F) is 5 kg/h and the number of KTM revolutions is 12000 rpm, a load-power value at the time of passing no sample ($W_0$) and a load-power value at the time of passing the sample ($W_1$) are recorded. The volume-average particle size D ($\mu$m) of the KTM ground sample is measured by means of Coulter Multisizer II (manufactured by Beckman Coulter Inc.). Based on the obtained values, the grindability index of the sample is calculated by the following equation:

$$\text{Grindability index}=[D\times(W_1-W_0)]/F$$

It is desirable that the glass transition point (Tg) of the polymer (B) is not less than 50° C., preferably 55–85° C., more preferably 60–80° C. If Tg is too low, the maintenance of heat resistance becomes worse. A certain maintenance of heat resistance of the toner can be ensured by controlling Tg of the polymer (B) within the aforesaid range even if the maintenance of heat resistance of the toner becomes problematic as Tg of the binder resin (A) is relatively low, because the present invention can achieve the construction wherein the polymer (B) is localized in the surface regions of the toner particles. It is desirable that the softening point of the polymer (B) is 110–150° C., preferably 120–145° C.

The values of the glass transition point of the polymer or resin used in the present specification were measured by means of a differential scanning calorimeter DSC-200 (manufactured by Seiko Instruments Inc.) under the following condition. The sample (10 mg) was heated from 20° C. to 120° C. with a heating rate of 10° C./min. Alumina was used as a reference. The shoulder value of a main endothermic peak within said temperature range was defined as the glass transition point.

The softening point was measured by means of Flow Tester CFT-500 (manufactured by Shimazu Corporation) under the following condition. The sample (1 $cm^3$) was flown out through a fine hole of a dice (diameter: 1 mm, length: 1 mm) at a pressure of 20 $kg/cm^2$ with a heating rate of 6° C./min. The temperature which corresponds to a half of the height between a starting point of the flow and an end point of the flow was defined as the softening point.

Kinds of the polymer (B) are not particularly restricted insofar that the polymer (B) is not compatible with the binder resin (A) when they are melted and kneaded and that the grindability of the polymer (B) is different from that of the binder resin (A). For example, homopolymers or copolymers of the publicly known aromatic monomers and/or aliphatic monomers may be employed as the polymer (B). The phrase of "the grindability of the polymer (B) is different from that of the binder resin (A)" means that the grindability of the polymer (B) is smaller than the grindability of the binder resin (A) by not less than 0.5, preferably not less than 0.7. When the polymer (B) and binder resin (A) which satisfy such a relationship concerning the grindability are not employed, the toner particles cannot be obtained wherein the polymer (B) particles are densely dispersed in the surface regions of the toner particles in comparison with the central parts of the toner particles since ground surfaces are randomly formed during the grinding process, and a grinding of the polymer (B) particles is not brought about because of connections of the dispersed polymer (B) particles.

As the aromatic monomer, styrene monomers represented by the following formula (1) and indene monomers represented by the following formula (2) are exemplified:

(1)

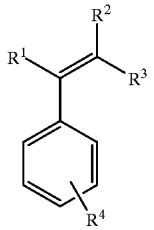

(wherein $R^1$, $R^2$, $R^3$ and $R^4$ indicate independently hydrogen atom, halogen atom or $C_1$–$C_4$-alkyl groups, such as methyl group, ethyl group, n-propyl group or n-butyl group, preferably hydrogen atom, chlorine atom, bromine atom or methyl group.)

(2)

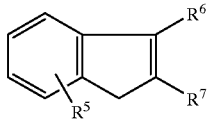

(wherein $R^5$, $R^6$ and $R^7$ indicate independently hydrogen atom, halogen atom or $C_1$–$C_6$-alkyl groups, such as methyl group, ethyl group, n-propyl group or n-butyl group, n-pentyl group or n-hexyl group, preferably hydrogen atom, chlorine atom, bromine atom or methyl group.)

As examples of sytrene monomers, the following monomers are exemplified: styrene, vinyltoluene, α-metylstyrene, isopropenyltoluene, β-methylstyrene, 1-propenyltoluene, o-chlorostyrene, m-chlorostyrene, p-chlorostyrene, β-chlorostyrene, β-chlorostyrene, o-bromostyrene, m-bromostyrene, p-bromostyrene, α-bromostyrene, β-bromostyrene, and the like. Preferable styrene monomers are styrene, vinyltoluene, α-methylstyrene, isopropenyltoluene, β-methylstyrene and 1-propenyltoluene, more preferably styrene, vinyltoluene, α-methylstyrene and isopropenyltoluene, in particular, styrene, α-methylstyrene and isopropenyltoluene.

As examples of indene monomers, indene, methylindene, ethylindene and the like can be mentioned. Among others, indene is particularly preferred. In this case, it is preferable to use high pure monomers from a viewpoint of decreasing a coloring, an odor and a content of VOC.

The aromatic monomers may be employed independently or jointly.

Although the following monomers may be exemplified as the aliphatic monomers, they are not particularly restricted insofar that they can polymerize with the aforesaid aromatic monomers: diolefin monomers, such as isoprene piperylene, 1,3-butadiene, 1,3-pentadiene, 1,5-hexadiene, 2,3-dimethyl-1,3-butadiene, chloroprene, 2-bromo-1,3-butadiene and the like; monoolefin monomers, such as ethylene, propylene, butylene, isobutylene, 2-methyl butene-1,2-methyl butene-2 and the like; alkyl acrylate monomers, such as methyl acrylate, ethyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl)butyl acrylate, hexyl acrylate, octyl acrylate, nonyl acrylate, decyl acrylate, undecyl acrylate, dodecyl acrylate and the like; alkyl methacrylate monomers, such as methyl methacrylate, ethyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl)butyl methacrylate, hexyl methacrylate, octyl methacrylate, nonyl methacrylate, decyl methacrylate, undecyl methacrylate, dodecyl methacrylate and the like; unsaturated carboxylic acids, such as acrylic acid, methacrylic acid, itaconic acid, maleic acid and the like; acrylonitrile, maleate, itconate, vinyl chloride, vinyl acetate, vinyl benzoate, vinyl methyl ethyl ketone, vinyl hexyl ketone, vinyl methyl ether, vinyl ethyl ether, vinyl isobutyl ether and the like. Preferable aliphatic monomers are monoolefin monomers and diolefin monomers, more preferably isoprene, piperylene, 2-methyl butene-1 and 2-methyl butene-2, in particular isoprene.

The aliphatic monomers may be employed independently or jointly.

Among the polymers (B) prepared by the aforementioned monomers, it is preferable to employ homopolymers or copolymers prepared by the aromatic monomers selected from a group consisting of styrene, vinyltoluene, α-methylstyrene, isopropenyltoluene and indene, preferably a group consisting of styrene, α-methylstyrene and isopropenyltoluene and/or by the aliphatic monomers selected from a group consisting of isoprene, piperylene, 2-methyl butene-1 and 2-methyl butene-2, preferably isoprene.

As the preferred polymers (B), it would be preferable to employ the polymers synthesized from the diolefins and monoolefins which are included in the cracked petroleum distillate produced as a by-product in a plant wherein ethylene, propylene and the like are prepared by a steam cracking of a kind of petroleum.

In the present invention, it is more preferable to employ the polymer (B) which comprises at least styrene and/or α-methylstyrene as a constitutional unit. As examples of the polymer (B), polystyrene, poly-α-methylstyrene, styrene/α-methylstyrene copolymer, α-methylstyrene/isopropenyltoluene/isoprene terpolymer, styrene/p-isopropenyltoluene/isoprene terpolymer and the like can be mentioned. Preferable polymer (B) is polystrene or poly-α-methylstyrene.

Although a weight ratio of the monomers for preparing the polymer (B) is not particularly restricted, it is desirable to adjust the weight ratio in such a way that a ratio of styrene and/or α-methylstyrene to the whole monomers is 50–100% by weight, preferably 60–100% by weight.

In the case where polystyrene is employed as the polymer (B), it is more preferable that polystyrene has weight-average molecular weight of 1000–2000.

In the case where poly-α-methylstyrene is used as the polymer (B), it is more preferable that poly-α-methylstyrene has weight-average molecular weight of 2000–2800.

A kind of binder resin (A) is not particularly restricted insofar that it is incompatible with the polymer (B) and satisfies the aforementioned relationship between the grindability of the binder resin (A) and that of the polymer (B). As such a binder resin (A), binder resins which are publicly known in the field of the toner for developing an electrostatic latent image, such as polyester resin, (meth)acrylic resin, styrene/(meth)acrylic copolymer resin, epoxy resin, COC (cyclic olefin resin; e.g. TOPAS-COC which is commercially available from Ticona Inc.) and the like are exemplified. It is preferable to employ the polyester resin for a full color toner which requires a highly efficient light transmission. In the case where a fixing apparatus which requires an oil-coating is employed, it is preferable to use polyester resin. In a system wherein an oil-coating is not required at the time of fixing or a very small amount of an oil is required at the time of fixing, it is preferable to use polyester resin, styrene/(meth)acrylic copolymer resin, epoxy resin, COC (cyclic olefin resin; e.g. TOPAS-COC which is commercially available from Ticona Inc.).

As the polyester resin, a polyester resin which is prepared by polycondensing a polyhydric alcohol and a polycarboxylic acid is preferably used in the present invention.

Among polyhydric alcohol components, examples of dihydric alcohol components include: bisphenol A-alkylene oxide adducts, such as polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane and polyoxyethylene(2,0)-2,2-bis(4-hydroxyphenyl)propane, ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polytetramethylene glycol, bisphenol A, hydrogenized bisphenol A, etc.

Examples of trihydric or more alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methyipropanetriol, 2-methyl-1,2,4-butanetriol, trimethylolethane, trimethylolpropane, and 1,3,5-trihydroxymethylbenzene.

Among polycarboxylic acid components, examples of dicarboxylic acid components include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenyl succinic acid, isododecenyl succinic acid, n-dodecyl succinic acid, isododecyl succinic acid, n-octenylsuccinic acid, isooctenyl succinic acid, n-octyl succinic acid, isooctyl succinic acid, and anhydrides or lower alkyl esters of these acids.

Examples of tri- or higher polycarboxylic acid components include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, empol trimer acid, anhydrides and lower alkyl esters of these acids.

In the present invention, with respect to the polyester resin, a monomeric material for a polyester resin, a monomeric material for a vinyl resin and a monomer that reacts with both of these monomeric materials are used, and a polycondensation reaction for obtaining the polyester resin and a radical polymerization reaction for obtaining the vinyl resin are carried out in parallel in the same reaction vessel; and resins thus obtained may be preferably used. The monomer that reacts with both of these monomeric materials is, in other words, a monomer that can be used in both a polycondensating reaction and a radical polymerization reaction. That is, the monomer has a carboxyl group that undergoes a polycondensating reaction and a vinyl group that undergoes a radical polymerization reaction. Examples thereof include fumaric acid, maleic acid, acrylic acid, methacrylic acid, etc.

Examples of the monomeric materials for polyester resins include the above-mentioned polyhydric alcohol components and polycarboxylic acid components.

Examples of the monomeric materials for vinyl resins include: styrene or styrene derivatives, such as o-methylstyrene, m-methylstyrene, p-methylstyrene, α-methylstyrene, p-ethylstyrene, 2,4-dimethylstyrene, p-tert-butylstyrene and p-chlorostyrene; ethylene unsaturated monoolefins, such as ethylene, propylene, butylene and isobutylene; methacrylic acid alkyl esters, such as methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl)butyl methacrylate, hexyl methacrylate, octyl methacrylate, nonyl methacrylate, decyl methacrylate, undecyl methacrylate and dodecyl methacrylate; acrylic acid alkyl esters, such as methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl) butyl acrylate, hexyl acrylate, octyl acrylate, nonyl acrylate, decyl acrylate, undecyl acrylate, and dodecyl acrylate; unsaturated carboxylic acids, such as acrylic acid, methacrylic acid, itaconic acid and maleic acid; acrylonitrile, maleic acid ester, itaconic acid ester, vinyl chloride, vinyl acetate, vinyl benzoate, vinyl methyl ethyl ketone, vinyl hexyl ketone, vinyl methyl ether, vinyl ethyl ether, and vinyl isobutyl ether. Examples of polymerization initiators used when the monomeric materials for vinyl resins are polymerized include azo or diazo polymerization initiators such as 2,2'-azobis(2,4-dimethylvaleronitrile, 2,2'-azobisisobutyronitrile, 1,1'-azobis(cyclohexane-1-carbonitrile) and 2,2'-azobis-4-methoxy-2,4-dimethylvaleronitrile and peroxide polymerization initiators such as benzoyl peroxide, methyl ethyl ketone peroxide, isopropylperoxycarbonate and lauroyl peroxide.

It is desirable that the binder resin (A) has an acid value of 2–50 KOHmg/g, preferably 5–40 KOHmg/g. Particularly, by employing the polyester resin having said acid value, it is possible to improve the dispersibilities of carbon black, various kinds of colorants and the like, and to prepare the toner having a sufficient electrification amount.

With respect to the acid value, a sample (10 mg) was dissolved in toluene (50 ml), and this solution was titrated by a standardized solution of N/10 potassium hydroxide/alcohol in the presence of a mixed indicator of 0.1% of bromothymol blue and phenol red. The acid value was calculated from the amount of consumption of the solution of N/10 potassium hydroxide/alcohol.

From the viewpoints of the maintenance of heat resistance, the reproducibilities of dot and color, the light transmission for OHP, the dispersibilities of the toner components (e.g. colorant, wax and the like), and the environmental stability concerning the electrification property (particularly, the electrification stability under the environment of high temperature and humidity), it is preferable to use the binder resin (acid value: 5–50 KOHmg/g, Mn: 2000–5000, Mw/Mn: 1.6–6, Tg: 50–70° C., Tm: 80–120° C.) when the fixing apparatus which requires an oil-coating is employed, and it is preferable to use the binder resin (acid value: 5–50 KOHmg/g, Mn: 1000–10000, Mw/Mn: 5–30, Tg: 50–75° C., Tm: 80–160° C.) when the system wherein an oil-coating is not required at the time of fixing or a very small amount of an oil is required at the time of fixing.

In the present invention, it is preferable to use two kinds of polyester resins having different softening points in order to improve the fixability and offset resistance as a toner for an oilless fixing in particular or to more effectively control a glossiness of an image in the full color toner which requires the light transmission. It is preferable to use the first polyester resin having the softening point of 95–120° C. in order to more improve the fixability and to use the second polyester resin having the softening point of 130–160° C. in order to more improve the offset resistance. In such a case, when the softening point of the first polyester resin is less than 95° C., the offset resistance and the reproducibility of dot are decreased, and when said softening point is more than 120° C., an improving effect of the fixability is insufficient. When the softening point of the second polyester resin is less than 130° C., an improving effect of the offset resistance is insufficient, and when said softening point is more than 160° C., the fixability is decreased. From a viewpoint of these facts, the preferred softening point of the first polyester resin and the preferred softening point of the second polyester resin are 100–115° C., and 135–155° C. respectively. It is desirable that the glass transition points of the first and second polyester resins are 50–75° C., preferably 55–70° C. When said glass transition points are too low, the heat resistance of the toner is insufficient, and when said glass transition points are too high, the fixing strength of the toner is insufficient.

As regards the first polyester resin, it is preferable to employ the polyester resin obtained by polycondensing the aforesaid polyhydric alcohol component and polycarboxylic acid component, in particular the polyester resin which is prepared by employing a bisphenol A-alkylene oxide adduct as a main polyhydric alcohol component and at least one carboxylic acid as a main polycarboxylic acid, said carboxylic acid being selected from a group consisting of terephthalic acid, fumaric acid, dodecenylsuccinic acid and benzenetricarboxylic acid.

As regards the second polyester resin, it is suitable to employ the polyester resin having the aforesaid composition concerning the first polyester resin as well as the polyester resin which is prepared by charging a mixture of a monomeric material for a polyester resin, a monomeric material for a vinyl resin and a monomer that reacts with both of these monomeric materials into the same reaction vessel, and then carrying out in parallel a polycondensation reaction for obtaining the polyester resin and a radical polymerization reaction for obtaining the vinyl resin. These resins are preferable from a viewpoint of improving the dispersibility of the wax as well as the toughness, fixability and offset resistance of the toner. A content of the vinyl resin in the second polyester resin is 5–40% by weight, preferably 10–35% by weight. When the content of the vinyl resin is less than 5% by weight, the fixing strength of the toner is decreased. On the other hand, when the content of the vinyl resin is more than 40% by weight, a decrease of the offset resistance and the toughness of the toner as well as a decrease of the negative electrification level and the like are easy to occur. In the case where the wax is highly filled in the toner in order to improve the oilless fixability or the fixability under the coating of a very small amount of the oil, it is necessary to suitably control the dispersion particle size of the wax. It is preferable to add the vinyl resin as an auxiliary means to suitably control the dispersion particle size of the wax. A desirable amount of the vinyl resin to be added is 5–40% by weight. When the amount of the vinyl resin is less than 5% by weight, an addition effect of the vinyl resin becomes weak, and the dispersion particle size of the wax is decreased. On the other hand, when the content of the vinyl resin is more than 40% by weight, the polyester resin does not exhibit its characteristic properties.

It is preferable that a weight ratio of the first polyester resin to the second polyester resin is 7:3–2:8, preferably 6:4–3:7. By using the first polyester resin and the second polyester resin within the aforesaid range, it is possible that (i) a spread of the toner due to its collapse at the time of fixing is reduced to bring about a superior reproducibility, (ii) a fixability at low temperature is excellent, and (iii) an excellent fixability is insured. An excellent reproducibility of dot can be maintained at the time of forming images on both sides (i.e. at the time of passing through the fixing apparatus twice). When an amount of the first polyester resin is less than the aforesaid range, the fixability at low temperature is insufficient, and a broad fixability cannot be insured. When an amount of the second polyester resin is less than the aforesaid range, the offset resistance is decreased, and the reproducibility of dot shows a tendency to decrease since the spread of the toner due to its collapse at the time of fixing is increased.

In the present invention, epoxy resin may be used as a part or the whole of the binder resin (A). A polycondensate of bisphenol A and epichlorohydrin and the like can suitably be used as epoxy resin which may be employed in the present invention. For example, the following commercially available products may be used: EPOMIC R362, R364, R365, R367 and R369 (Mitsui Chemicals, Inc.), EPITOT YD-011, YD-012, YD-014, YD-904 and YD-017 (Tohto Kasei Co., Ltd.), EPICOAT 1002, 1004, 1007 (Shell Chemicals, Ltd.) and the like.

At the time of preparing the toner according to the present invention, the binder resin (A), the polymer (B), the colorant and other additives (e.g. charge-control agent, releasant etc.) are mixed by means of the publicly known mixing apparatus (e.g. Henschel mixer and the like), the mixture obtained is melted and kneaded by means of the publicly known kneading apparatus, and the melted mixture is cooled to obtain the kneaded product. Although a kneader equipped with one, two or more rotating shafts (e.g. screw, rotor, roll etc.) may be used, a screw extruder is mainly employed from the viewpoints of a productivity, a long-term durability and the like.

In the kneaded product according to the present invention, the polymer (B) is uniformly dispersed in the binder resin (A), and the mean dispersion particle size of the polymer (B) is controlled to 0.05–2.5 $\mu$m, preferably 0.08–2 $\mu$m, more preferably 0.1–1.5 $\mu$m. Preferably, more than 95% of the dispersed particles have a particle size of less than 2 $\mu$m. When the dispersion state of the polymer (B) in the kneaded product is controlled under the aforesaid condition, the kneaded product is ground in the subsequent grinding process in such a way that the dispersed particles of the polymer (B) are connected to form the ground surfaces. Consequently, the toner particles wherein the polymer (B) is localized to the surface regions of said particles can be obtained in an excellent productivity. It is thinkable that the ground surfaces are constructed by the polymer (B), and the obtained toner particles have a construction wherein the polymer (B) is localized to the surface layer parts (preferably, the polymer (B) is exposed on the surfaces of the toner particles) since a grinding is brought about not on the contact surface (interface) between the binder resin (A) and the polymer (B) particles, but through the insides of the polymer (B) particles in the regions in particular where the polymer (B) particles exist which are dispersed in the kneaded product. Furthermore, by controlling the dispersion state of the polymer (B) in the kneaded product under the aforesaid condition, an occurrence of a separation (disconnection) of the polymer (B) particles the toner particles in the developing apparatus can be prevented, and a sticking or an adhering to a carrier (for one component developer) or a developing sleeve and a regulating blade (for one component developer) can be prevented, and a stable electrifiability can be maintained.

When the dispersion particle size of the polymer (B) in the aforesaid kneaded product is too large, the toner particles cannot be obtained wherein the polymer (B) is densely dispersed in the surface regions. In such a case, it is thinkable that when the kneaded product is subjected to the grinding treatment, a grinding to connect the polymer (B) particles does not occur, and a grinding occurs wherein the polymer (B) particles function as a central starting point, and a control of the ground surfaces becomes impossible, because the connections of the dispersed polymer (B) particles in the kneaded product is hard to manintain. Accordingly, it is worth considering an increase of an amount of the polymer (B) to be used in order to maintain the connection of the dispersed polymer (B) particles in the kneaded product. However, when said amount to be used is increased, (i) an overgrinding occurs in the grinding process, (ii) a desired distribution of particle size cannot be obtained, (iii) a direct yield at the time of production is decreased, (iv) the components (especially the polymer (B) particles) which constitute the surfaces of the toner particles become ununiform, and (v) a uniformity of charge quantity etc. cannot be obtained. In addition, when the toner particles which comprises the polymer (B) whose dispersion particle size is too large in the kneaded product is used in combination with the binder resin (A) having low glass transition point, the maintenance of heat resistance is remarkably decreased, and a selection range of the binder resin (A) is restricted, since an existing amount of the binder resin (A) on the surfaces of said toner particles becomes richer in comparison with the case of the toner particles according to the present invention. This fact is unfavorable to a design of a toner for fixing at low temperature or a full-color toner. On the other hand, when the dispersion particle size of the polymer (B) is too small, it is impossible to obtain the toner particles wherein the polymer (B) is densely dispersed in the surface regions. It is thinkable that the ground surfaces cannot be controlled since the dispersed particles of the polymer (B) are gotten into a state wherein the connections of said dispersed particles cannot be specified or controlled, and a grinding inside the polymer (B) particles cannot be achieved when said dispersion particle size is too small.

In the present invention, the dispersion particle size of the polymer (B) in the particles of the coarsely ground toner product (volume-mean particle size: about 2 mm), which is prepared in the aftermentioned grinding process, may be fallen into the aforesaid range since it is hard to measure the dispersion particle size of the polymer (B) in the kneaded product. Furthermore, the dispersion particle size of the polymer (B) in the kneaded product does not differ from that of the polymer (B) in the particles of the coarsely ground toner product (volume-mean particle size: about 2 mm).

The amount of the polymer (B) to be used is determined depending on the particle size of the toner particles to be obtained since the polymer (B) is localized in the surface layer parts of the toner particles in the case of the toner according to the present invention. For example, in the case of toner particles having the volume-average particle size of 5–8 $\mu$m, particularly 6–7 $\mu$m, a usually used amount of the polymer (B) is 1.5–25 parts by weight, preferably 2–15 parts by weight, more preferably 2.5–10 parts by weight with respect to 100 parts by weight of the binder resin (A). Two or more kinds of the polymer (B) may jointly be used. In such a case, the total amount of the polymer (B) may be fallen to the aforesaid range. When the amount of the polymer (B) to be used is too much, the toner according to the present invention cannot be obtained, i.e., as described above, the overgrinding occurs in the grinding process, and not only the direct yield at the time of production is decreased, but also the uniformity of charge quantity and the like cannot be maintained. On the other hand, when the amount of the polymer (B) is too small, the effect of increasing a grinding efficiency becomes lower. As stated above, the desired grindability can be maintained without adding more than a necessary amount of the polymer (B), and it is thinkable that this is one of the factors which can effectively suppress the side effects of the polymer (B), such as decreases of the fixing strength, the offset resistance, the smear-preventive property and the light transmission for OHP.

A dispersed state of the polymer (B) in the kneaded product which is obtained by cooling the melted and kneaded mixture can be controlled by suitably changing the volume-average particle size of the polymer (B) to be used, the mixing condition before kneading, the kneading condition and the like. That is to say, when the particle size of the polymer (B) is smaller, the mean dispersion particle size of the polymer (B) in the kneaded product becomes smaller. Furthermore, the mixing and kneading conditions are intensified, the mean dispersion particle size of the polymer (B) in the kneaded product becomes smaller. Concretely speaking, for example, in the case where the polymer (B) (volume-average particle size: 1–5 mm) is mixed together with other toner materials by means of Henschel mixer, and the mixture is melted and kneaded by means of twin-screw extruding kneader PCM-30 (manufactured by Ikegai Tekko K.K.), the kneaded product wherein the polymer (B) having the aforesaid dispersion particle size is uniformly dispersed can be obtained by selecting the following conditions:

Mixing speed of Henschel mixer; 20–50 m/s (peripheral speed)

Mixing time; 2–10 min

Kneading temperature of the kneader; 120–200° C.

Passing time of the materials to be treated of the kneader; 1–5 min

As the colorant used in the present invention, the publicly known pigments and dyes which have formerly been used as a colorant for a full-color toner may be employed. The following pigments and dyes are exemplified: carbon black, aniline blue, chalcoyl chrome yellow, ultramarine blue, DUPONT oil red, quinoline yellow, methylene blue chloride, copper phthalocyanine blue, malachite green oxalate, lamp black, rose bengal, C.I. pigment red 48:1, C.I. pigment red 122, C.I. pigment red 57:1, C.I. pigment red 184, C.I. pigment yellow 97, C.I. pigment yellow 12, C.I. pigment yellow 17, C.I. solvent yellow 162, C.I. pigment yellow 180, C.I. pigment yellow 185, C.I. pigment blue 15:1, C.I. pigment blue 15:3, and the like.

Contents of magenta, cyan and yellow in the toner is preferably 2–15 parts by weight with respect to 100 parts by weight of the binder resin (A). It is preferable to use the magenta, cyan and yellow as a master batch which can be prepared by previously melting and kneading these colorants with the binder resin (A) and then grinding the kneaded mixture. In such a case, the contents of these colorants in the toner to be obtained may be fallen into the aforesaid range.

In the case of black toner, a magnetic material can be substituted for a part of the whole of the colorants, such as various kinds of carbon blacks, active carbon, titanium black and the like. In the present invention, contents of the colorants in a nonmagnetic black toner is preferably 2–15 parts by weight with respect to 100 parts by weight of the binder resin (A). Fine particles of the publicly known magnetic materials, such as ferrite, magnetite, iron and the like can be used as such a magnetic material. The preferable mean particle size of the magnetic materials is not more than 1 $\mu$m, particularly not more than 0.5 $\mu$m from the viewpoint of their dispersibility at the time of preparing the black toner. In the case where the magnetic material is added to the toner from the viewpoint of a prevention of a scattering and the like while a property of the nonmagnetic toner is maintained, an amount of the magnetic material to be added is 0.5–10 parts by weight, preferably 0.5–8 parts by weight, more preferably 1–5 parts by weight with respect to 100 parts by weight of the binder resin (A). When said amount exceeds 1 parts by weight, a magnetic binding force of a developer-supporting member with a built-in magnet roller becomes stronger, and a developability is reduced. An amount of the magnetic material to be added to the magnetic toner is preferably 20–60 parts by weight. When said amount is less than 20 parts by weight, a scattering of the toner is apt to increase. On the other hand, when said amount exceeds 60 parts by weight, a charge quantity of the toner cannot stably be maintained, and a decrease of image quality is brought about.

As a charge-control agent which may be added to the toner of the present invention as occasion demands, the publicly known charge-control agents which have formerly been employed for controlling an electrifiability of the toner in the field of the toner for developing an electrostatic image can be used. For example, a fluorine surfactant, a metal-containing dye, such as a metal complex of salicylic acid, a boron metal complex, an azo metal complex and the like, and a high molecular acid, such as a copolymer which contains maleic acid as a monomer component and the like may be employed. The metal complex of salicylic acid and the boron metal complex are preferable. Particularly, a boron-containing metal complex of salicylic acid can suitably be employed. Although an amount the charge-control agent to be added changes depending on the kinds of other materials on a process to be used, said amount is 0.1–5 parts by weight, preferably 0.5–3 parts by weight with respect to 100 parts by weight of the binder resin (A).

As an example of the metal complex of salicylic acid which can suitably used, the compounds represented by the following formulae (I)–(III) may be exemplified:

(I)

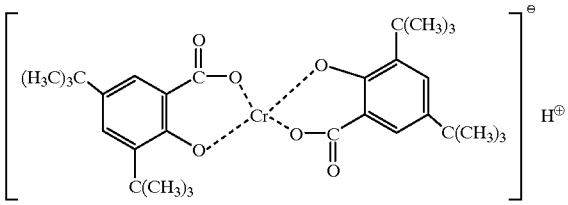

(II)

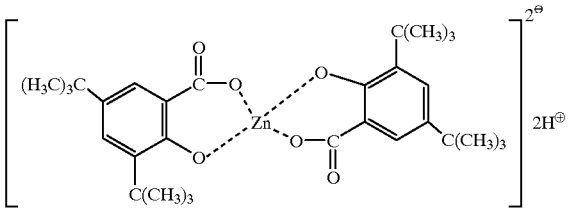

(III)

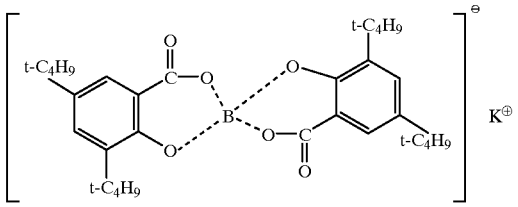

In addition, as an example of the boron metal complex which can suitably used, the compound represented by the following formula (IV) may be exemplified:

(IV)

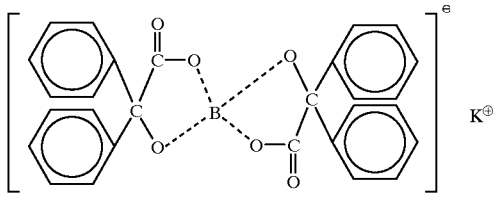

Various kinds of resins having a polar functional group (e.g. sulfonic group, fluorine-containing group, silicon-containing group and the like) which has an effect on a negative electrifiability (charge-control resin) may be added to the toner. The charge-control resin (CCR) may be a homopolymer or copolymer of a monomer having a polar functional group, or a copolymer prepared by copolymerizing the monomer having a polar functional group with a monofunctional monomer (e.g. styrene monomer, (meth) acrylic monomer and the like) and/or polyfunctional monomer, a polymer blend of a polymer prepared by polymerizing the monofunctional monomer and/or polyfunctional monomer and a polymer comprising the monomer having a polar functional group. In the case where the charge-control resin is added to the toner, its amount to be added is 0.1–5 parts by weight with respect to 100 parts by weight of the binder resin (A).

A wax may be added as a releasant to the toner according to the present invention. By adding the wax to the toner, it is possible that the offset resistance and the separability at the time of fixing are more increased in the oilless fixing method or the fixing method wherein a very small amount of oil is coated and that a gloss range is suitably controlled without occurring a gloss unevenness in the wider temperature range. As the wax, the publicly known waxes in the field of the toner for developing an electrostatic image can be used. For example, polyethylene wax, oxidized polyethylene wax, oxidized polypropylene wax, carnauba wax, montan ester wax, rice wax, Fischer-Tropsch wax, SASOL wax and the like can be mentioned.

In the present invention, it is preferable to use two or more kinds of waxes having different melting points. The melting point difference between two kinds of waxes is at least not less than 20° C., preferably not less than 30° C., more preferably not less than 40° C. When two or more kinds of waxes having different melting points are jointly used, it is easy to maintain a separability between the fixing apparatus and a media in the wide temperature range. From the viewpoint of more increase of the offset resistance and the like, it is preferable to add polypropylene wax as one kind of wax. Particularly, it is preferable to employ polypropylene wax as a high melting point wax. It is preferable to add polyethylene wax as a low melting point wax to the toner from the viewpoint of improving the smear phenomenon wherein the deteriorations of the image quality, such as a blot and a stain of the images and the like which are caused by the rubbing of the images with the roller at the time of automatically sending a manuscript or at the time of sending the paper whose one side has already been imaged in case of copying both sides of a paper. As a polypropylene wax, the polypropylene wax which has a melt viscosity of 50–300 cps/160° C., a softening point of 130–160° C. and an acid value of 1–20 KOHmg/g is exemplified. Besides the aforementioned polyethylene wax, various kinds of natural wax, Fischer-Tropsch wax, montan acid wax, ester wax and paraffin wax can suitably be employed as a low melting point wax. Particularly, it is preferable to use montan acid wax and ester wax. The polypropylene wax having the aforesaid melt viscosity, softening point and acid value exhibits and excellent dispersibility to the aforesaid binder resin (A), and achieves the increase of offset resistance without bringing about the problem caused by the liberated wax. It is preferable to use an oxidized-type wax when the polyester resin in particular is employed as the binder resin.

Oxidized-type Polyethylene Wax

Commercially available oxidized-type polyethylene wax may be employed. The following commercially available products are exemplified: SAN WAX E300 (softening point 103.5° C., acid value 22) and SAN WAX E250P (softening point 103.5° C., acid value 19.5), made by Sanyo Chemical Industries, Ltd.; HI-WAX 4053 E (softening point 145° C., acid value 25), 405 MP (softening point 128° C., acid value 1.0), 310 MP (softening point 122° C., acid value 1.0), 320 MP (softening point 114° C., acid value 1.0), 210 MP (softening point 118° C., acid value 1.0), 220 MP (softening point 113° C., acid value 1.0), 4051 E (softening point 120° C., acid value 12), 4052 E (softening point 115° C., acid value 20), 4202 E (softening point 107° C., acid value 17) and 2203 A (softening point 111° C., acid value 30), made by Mitsui Chemicals, Inc., etc.

Oxidized-type Polypropylene Wax

Low molecular weight polypropylene has a small hardness to cause the defect of lowering the toner fluidity. It is preferable that those waxes are modified with carboxylic acid or acid anhydride in order to improve the above defects. In particular, modified polypropylene resins in which a low molecular polypropylene resin is modified with one or more kinds of acid monomers selected from the group consisting of (metha)acrylate, maleic acid and maleic acid anhydride, are preferably used. Such a modified polypropylene may be obtained, for example, by subjecting a polypropylene resin to a graft or addition reaction with one or more kinds of acid monomers selected from the group consisting of (metha) acrylate, maleic acid and maleic acid anhydride in the presence of a peroxide catalyst or without a catalyst. When the modified polypropylene is used, the acid value is set in the range of 0.5 to 30 KOHmg/g, preferably 1 to 20 KOHmg/g.

With respect to the oxidized-type polypropylene waxes, VISCOL 200 TS (softening point 140° C., acid value 3.5), VISCOL 100 TS (softening point 140° C., acid value 3.5), VISCOL 110 TS (softening point 140° C., acid value 3.5), each of which is made by Sanyo Chemical Industries, Ltd., etc., are commercially available.

Carnauba Wax

When carnauba wax is used, the ones of fine crystal particles are preferably used with their acid value preferably in the range of 0.5 to 10 KOHmg/g, preferably 1 to 6 KOHmg/g.

Montan Wax

Montan wax generally refers to montan ester wax refined from minerals, being in the form of fine crystals as well as carnauba wax; the acid value thereof is preferably in the range of 1 to 20 KOHmg/g, and more preferably, 3 to 15 KOHmg/g.

Rice Wax

Rice wax is obtained by air-oxidizing rice bran wax, and its acid value being preferably in the range of 5 to 30 KOHmg/g.

Fischer-Tropsch Wax

Fischer-Tropsch wax is a wax that is produced as a byproduct when synthetic oil is produced from coal according to the hydrocarbon-synthesizing method. Such a wax, for example, is available as trade name "SAZOL WAX" made by Sazol K.K. Fischer-Tropsch wax, made from natural gas as a starting material, may be preferably used since it contains less low molecular weight ingredients and exhibits a superior heat resistance when used with toner.

With respect to the acid value of Fischer-Tropsch wax, those having an acid value of 0.5 to 30 KOHmg/g may be used. Among SAZOL waxes, those of oxidized type having an acid value of 3 to 30 KOHmg/g (trade name: SAZOL wax A1, A2, etc.) are, in particular, preferably used. Polyethylene wax having the above-mentioned melt viscosity and softening point also exhibits a superior dispersing properties to the binder resin, thereby improving the smear-preventive properties because frictional coefficient of the surface of a fixed image is reduced without causing problems due to isolated wax. The melt viscosity of wax was measured by a viscometer of the Brook Field type.

In the case where the releasant is added to the toner, it is desirable that the total amount of the releasant to be added is 2–20 parts by weight, preferably 3–15 parts by weight, more preferably 4–12 parts by weight, per 100 parts by weight of the binder resin (A).

In the present invention, the kneaded product wherein the polymer (B) having the specified particle size is uniformly dispersed is ground, classified and subjected to a surface-modifying treatment if necessary, said kneaded product being obtained as mentioned above. In the grinding process, the kneaded product is usually ground coarsely by means of a feather mill and the like, and then finely ground by means of a mechanical grinding apparatus wherein a high-speed gas-flow impact method is applied [e.g. CRIPTON System KTM (manufactured by Kawasaki Heavy Industries Ltd.), INOMIZER System (manufactured by Hosokawa Micron Corporation), Fine Mill (manufactured by Nippon Pneumatic Mfg. Co., Ltd.), Turbo Mill (manufactured by Turbo Kogyo Co., Ltd.) and the like] and/or a collision plate and a jet mill wherein the toner particles are ground by carrying the toner particles on a jet stream [e.g. I type Jet Mill (manufactured by Nippon Pneumatic Mfg. Co., Ltd.), PJM (manufactured by Nippon Pneumatic Mfg. Co., Ltd.), AFG (manufactured by Hosokawa Micron Corporation) and the like]. It is preferable that (i) the kneaded product is coarsely ground by means of the feather mill to form a coarsely ground product having a volume-average particle size of about 2 mm, (ii) the coarsely ground product is treated by means of the mechanical grinding apparatus, such as CRIPTON System KTM (manufactured by Kawasaki Heavy Industries Ltd.) and the like to form a finely ground product having a volume-average particle size of about 10 $\mu$m, and then (iii) the finely ground product is more finely ground by means of the jet mill, such as AFG (manufactured by Hosokawa Micron Corporation) and the like. In the present invention, it is desirable that a volume-average particle size of the finally obtained ground particles is 4–8 $\mu$m, preferably 5–7 $\mu$m.

In the grinding process, the kneaded product is, as described above, effectively ground while the ground surfaces are formed in such a way that the dispersed particles of the polymer (B) are combined (particularly, the grinding of the kneaded product is occurred in the places of said product where the polymer (B) particles exist through the insides of said particles), since the polymer (B) having the specified particle size is uniformly dispersed in the kneaded product which is supplied to the grinding process.

In the present invention, the dispersion particle size of the polymer (B) in the coarsely ground toner particles having a volume-average particle size of about 2 mm is the same as that of the polymer (B) in the aforesaid kneaded product. The dispersion particle size of the polymer (B) in the coarsely ground toner particles can be measured by taking a microscopic photograph (10000 magnifications) of the particles which are sliced with a microtome by means of a transmission electron microscope (TEM).

As a classifier used in the classifying process, the publicly known classifiers may be used insofar that the ground product can be classified into a ground product having a desirable particle size. For example, ELBOW JET (manufactured by Nittetsu Mining Co., Ltd.), DS Classifier (manufactured by Nippon Pneumatic Mfg. Co., Ltd.), TEEPLEX Classifier (manufactured by Hosokawa Micron Corporation) and the like can be employed. It is preferable to use TEEPLEX Classifier (manufactured by Hosokawa Micron Corporation) and the like which sphere the particles to be treated.

As an apparatus used in the surface-modifying treatment which is carried out as occasion demands, the publicly known apparatuses can be used insofar that the shapes of the toner particles can be controlled. For example, the toner particles may be subjected to the instantaneous heating treatment or the treatment with a mechanical impact force or the like by means of the apparatuses. Examples of these surface-modifying apparatuses include an apparatus wherein the instantaneous heating treatment method is applied [e.g. SURFUSING System (manufactured by Nippon Pneumatic Mfg. Co., Ltd.) and the like], an apparatus wherein the high-speed gas-flow impact method [e.g. Hybridization System (manufactured by Nara Kikai Seisakusho Inc.), CRIPTON COSMOS Series (manufactured by Kawasaki Heavy Industries Ltd.), INOMIZER System (manufactured by Hosokawa Micron Corporation), Turbomill (manufactured by Turbo Kogyo Co., Ltd.) and the like], an apparatus wherein the dry mechanochemical method is applied [e.g. MECHANOFUSION System (manufactured by Hosokawa Micron Corporation), MECHANOMILL (manufactured by Okada Seiko Co., Ltd.) and the like], an apparatus wherein the wet coating method is applied [e.g. DISPACOAT (manufactured by Nisshin Engineering Inc.), COATMIZER (manufactured by Freund Sangyo Inc.) and the like. These apparatuses may appropriately used in a combined manner.

It is preferable to add various kinds of organic/inorganic fine particles to the toner of the present invention as a fluidizing agent after the toner particles are prepared. As the inorganic fine partlicles, the following compounds are exemplified: various oxides, such as titanium oxide, magnesium oxide, aluminum oxide, silica and colloidal silica; various titanic acid compounds, such as calcium titanate, magnesium titanate and strontium titanate; various metal soaps, such as aluminum stearate, calcium stearate, zinc stearate and magnesium stearate; and various nonmagnetic inorganic fine particles such as talc and bentonite. These materials may be used alone or in combination. In particular, it is preferable that the inorganic fine particles, such as silica, titanium oxide, alumina and zinc oxide are treated by a known method with a conventionally used hydrophobisizing agent, such as a silane coupling agent, a titanate coupling agent, silicone oil and silicone vanish, or with a treatment agent, such as a fluorine silane coupling agent or fluorine silicone oil, a coupling agent having an amino group or a quaternary ammonium salt group, and a modified silicone oil.

With respect to the organic fine particles, various organic fine particles, such as styrene particles, (metha)acrylic particles, benzoguanamine, melamine, Teflon, silicon, polyethylene and polypropylene, which are formed into particles by a wet polymerization method such as an emulsion polymerization method, a soap-free emulsion polymerization method and a non-aqueous dispersion polymerization method, and a vapor phase method, etc, may be used as a cleaning-assist agent and the like.

Inorganic fine particles, such as titanate metal salts, having a comparatively large particle size, and various organic fine particles may be, or may not be subjected to a hydrophobicizing treatment.

Amounts of these fine particles to be added is 0.1–6 parts by weight, preferably 0.5–3 parts by weight with respect to 100 parts by weight of the toner particles. Two or more kinds of these fine particles may jointly be employed. In such a case, the total amount of these fine particles may be fallen into the aforesaid range.

The toner of the present invention obtained by the aforementioned methods has a relatively high roundness as well as a relatively uniform shape, and hardly contains particles having finer or larger particle size.

It is desirable that a mean dispersion particle size of the polymer (B) in the toner particles which constitute the toner of the present invention is not more than 1.5 $\mu$m, preferably 0.05–1.0 $\mu$m, more preferably 0.08–0.8 $\mu$m, particularly 0.1–0.5 $\mu$m. Said dispersion particle size can be measured by the same method as that for measuring the dispersion particles size of the polymer (B) in the particles of the aforesaid coarsely ground toner.

Furthermore, the toner according to the present invention has a high roundness and a sharp distribution of particle size. A difference of electrification amount due to a color difference is relatively small since the polymer (B) exists richly in the surface layer of the toner, and even though the glass transition point of the binder resin (A) is relatively low, the maintenance of heat resistance can be maintained by setting the glass transition point of the polymer (B) high. For this reason, the toner according to the present invention is suitable for making a full-color image. In addition, the toner of the present invention can effectively be applied to a cleanerless system having no mechanism to clean a residual toner on a supporting member for an electrostatic image (photosensitive member) and an intermediate transferring member as well as a toner-recycling system that reuses a recovered toner in a cleaner part.

In the case where the toner of the present invention is used as a negatively chargeable toner, the toner can effectively exert a negative electrifiability without a charge-control agent and can bring about an effect to prevent an occurrence of a reversely chargeable toner since the polymer (B) is densely dispersed in the surface layer part of the toner particles and the polymer (B) is apt to charge negatively.

EXAMPLES

Preparation of a Binder Resin (Polyester Resin)

An alcohol component, an acid component and a polymerization initiator (dibutyltin oxide) were charged into the four-necked flask made of glass in a molar ratio shown in Table 1, said flask equipping with a thermometer, an agitator, a reflux condenser and a tube for introducing nitrogen gas. The reaction was carried out by heating the mixture with a mantle heater under an atmosphere of nitrogen while said mixture was stirred. The progress of the reaction was pursued by measuring an acid value of the reaction mixture. When the acid value reached the prescribed value, the reaction was stopped and the reaction product was cooled to room temperature to obtain the polyester resins H1, L1 and L2. The obtained polyester resins were coarsely ground (≦2 mm), and used independently or jointly as the polyester resins A-1-A-5 for preparing the toners. The obtained polyester resins have the physical properties shown in Table 1. In Table 1, PO,EO, TPA, TMA and FA indicate polyoxypropylene (2,2)-2,2-bis(4-hydroxyphenyl)propane, polyoxyethylene (2,0)-2,2-bis(4-hydroxyphenyl)propane, terephthalic acid, trimelitic acid and fumaric acid respectively.

Preparation of the Polymer (B)

(1) Resin B-1

Styrene (purity: 99.9%)(150 g) and toluene (150 g) were charged into an autoclave, and $BF_3$-phenol complex (1.5 g) was added to the mixture little by little for about 10 minutes with stirring while a temperature of the mixture was kept at 5° C. Then the stirring was continued for additional 3 hours, and 5% aqueous solution of sodium hydroxide (50 ml) was added to the reaction mixture, and the mixture obtained was vigorously stirred for 30 minutes to decompose the catalyst. After an aqueous layer was separated, the polymerized oil was washed with water until it became neutral, and then unreacted components and the solvent (toluene) were distilled off to obtain the polystyrene as the residue. The polystyrene is referred to as resin B-1, and physical properties thereof are shown in Table 2.

(2) Resin B-2

α-Methylstyrene (purity: 99.9%)(150 g) and toluene (150 g) were charged into an autoclave, and $BF_3$-phenol complex (1.5 g) was added to the mixture little by little for about 10 minutes with stirring while a temperature of the mixture was kept at 5° C. Then the stirring was continued for additional 3 hours, and 5% aqueous solution of sodium hydroxide (50 ml) was added to the reaction mixture, and the mixture obtained was vigorously stirred for 30 minutes to decompose the catalyst. After an aqueous layer was separated, the polymerized oil was washed with water until it became neutral, and then unreacted components and the solvent (toluene) were distilled off to obtain the poly-α-methylstyrene as the residue. The poly-α-methylstyrene is referred to as resin B-2, and physical properties thereof are shown in Table 2.

(3) Resin B-3

α-Methylstyrene (purity: 99.9%)(150 g) and toluene (150 g) were charged into an autoclave, and $BF_3$-phenol complex (1.5 g) was added to the mixture little by little for about 10 minutes with stirring while a temperature of the mixture was kept at 5° C. Then the stirring was continued for additional 3 hours, and 5% aqueous solution of sodium hydroxide (50 ml) was added to the reaction mixture, and the mixture obtained was vigorously stirred for 30 minutes to decompose the catalyst. After an aqueous layer was separated, the polymerized oil was washed with water until it became neutral, and then unreacted components and the solvent (toluene) were repeatedly distilled off to obtain the poly-α-methylstyrene copolymer as the residue. The poly-α-methylstyrene copolymer is referred to as resin B-3, and physical properties thereof are shown in Table 2. Particularly, in the case of preparing a copolymer, unreacted components are apt to remain, and an odor of the copolymer as well as a residual VOC (volatile component) are apt to bring about a problem. Therefore, the copolymer was sufficiently purified after the polymerization by removing the residual materials repeatedly and carefully in order to conform with the use of the materials having a high purity.

(4) Resin B-4

Isopropenyl toluene (purity: 98%)(200 g), α-methylstyrene (purity: 98%)(200 g), CS petroleum fraction (isoprene) obtained by a thermal decomposition of a petroleum naphtha (120 g) and toluene (500 g) were charged into a three-necked flask, and $BF_3$-phenol complex was added to the mixture little by little with stirring while the mixture in the flask was cooled with a dry ice bath, and the reaction was carried out for 3 hours. Then 5% aqueous solution of sodium hydroxide was added to the reaction mixture, and the mixture obtained was vigorously stirred for 30 minutes to decompose the catalyst. After an aqueous layer was separated, the polymerized oil was washed with water until it became neutral, and then unreacted components and the solvent (toluene) were distilled off by heating the washed polymerized oil under reduced pressure to obtain the isopropenyl toluene-α-methylstyrene-isoprene terpolymer as the residue. The terpolymer is referred to as resin B-4, and physical properties thereof are shown in Table 2. A purity of the terpolymer was increased by carefully removing the residual materials in the same manner as in the case of the resin B-3.

(5) Resin B-5

Polystyrene was obtained by the same preparation method as that of the resin B-1 except that the reaction was carried out for 2 hours. The polystyrene is referred to as resin B-5, and physical properties thereof are shown in Table 2.

(6) Resin B-6 (Aromatic Homopolymer)

Poly-α-methylstyrene was obtained by the same preparation method as that of the resin B-2 except that the reaction was carried out for 4.5 hours. The poly-α-methylstyrene is referred to as resin B-6, and physical properties thereof are shown in Table 2.

Preparation of a Pigment Master Batch

A pigment to be used for preparing a full-color toner was employed as the pigment master batch prepared by the following method. A binder resin and a pigment to be used in each example or comparative example were charged into a press kneader in a weight ratio (resin:pigment) of 7:3, and the mixture wad kneaded at 120° C. for 1 hour. After cooling, the kneaded product was coarsely ground to obtain the pigment master batch which contains 30% by weight of each color of yellow, magenta and cyan. As the pigments, C.I. Pigment Yellow 180 (Hoechst Inc.), C.I. Pigment Blue 15-3 (Dainippon Ink and Chemicals, Inc.) and C.I. Pigment Red 184 (Dainippon Ink and Chemicals, Inc.) were used.

Preparation of a Toner

Example 1

Toner Y-1

The polyester resin A-1 and pigment master batch were used in such a way that the amounts of the polyester resin A-1 and C.I. Pigment Yellow 180 were 100 parts by weight and 7.0 parts by weight respectively. The resin B-1 (5 parts by weight) was added to this blend, and the mixture obtained was mixed for 5 minutes by means of Henschel mixer (peripheral speed: 40 m/s) under the condition that a temperature of the mixture does not exceed 45° C., and then the mixture was melted and kneaded by means of the twin-extruding kneader PCM-30 (manufactured by Ikegai Tekko K.K.) whose discharge part was detached. The kneading time was 170° C., and the transit time of the mixture to be treated was about 1 minute. The kneaded product was rolled by means of a cooling press roller to obtain a rolled sheet whose thickness is 2 mm, and the rolled sheet was cooled by a cooling belt and coarsely ground by means of the feather mill (mesh size: 2 mm pass). Then the coarsely ground product was subjected to a grinding treatment by means of the mechanical grinder KTM-0 type (Kawasaki Heavy Industries Ltd.) to obtain the ground product having an average particle size of about 10 μm, and said ground product was finely ground by means of the jet grinder AFG (Hosokawa Micron Corporation) to obtain the finely ground product having an average particle size of 5.8 μm. The finely ground product was finely classified by means of the rotor type classifier (TEEPLEX classifier type 100 ATP made by Hosokawa Micron Corporation) to obtain yellow toner particles having a volume-average particle size (D) of 6.1 μm wherein a content of the particles having a particle size of not less than 2 D is 0% by weight and a content of the particles having a particle size of not more than 2.5 μm is 0% by volume. A mean roundness of the yellow toner particles was 0.960, and a standard deviation of roundness was 0.036. Hydrophobic silica (TS-500: Cabosil Inc.)(0.5 part by weight), titanium oxide (STT30A: Titan Kogyo K.K.)(1.0 part by weight) and strontium titanate having an average particle size of 0.2 μm (1.0 part by weight) were added to the yellow toner particles (100 parts by weight), and the mixture was treated for 60 seconds by means of Henschel mixer (peripheral speed: 40 m/sec) and then sifted with a sieve having a mesh size of 90 μm to obtain the yellow toner Y-1.

Examples 2 and 3

Toners C-1 and M-1

The toner C-1 or M-1 was obtained by the same preparation method as that described in example 1 except that the polyester resin A-1 and another pigment master batch were used in such a way that the amounts of the polyester resin A-1 and C.I. Pigment Blue 15-3 were 100 parts by weight and 5.0 parts by weight respectively or that the amounts of the polyester resin A-1 and C.I. Pigment Red 184 were 100 parts by weight and 4.5 parts by weight respectively.

Example 4

Toner Bk-1

The toner Bk-1 was obtained by the same preparation method as that described in example 1 except that an acid carbon black "MOGUL L" (pH:2.5; average primary particle size: 24 nm) supplied by Cabot Corporation was used as a substitute for the pigment master batch and that the polyester resin A-1 and the acid carbon black were used in such a way that the amounts of the former and the latter were 100 parts by weight and 8.0 parts by weight respectively.

Examples 5–7 and Comparative Examples 1–2

Toners C-2~C-6

The toners C-2~C-6 were obtained by the same preparation method as that described in example 2 except that the resins B-2~B-6 were used as a substitute for the resin B-1.

Example 8 and Comparative Examples 3–5

Toners C-7~C-10

The toners C-7~C-10 were obtained by the same preparation method as that described in example 2 except that the amount of the resin B-1 was changed to 0 (unused), 1, 10 and 20 parts by weight respectively.

Comparative Example 6

Toner C-11

The toner C-11 was obtained by the same preparation method as that described in example 2 except that the polyester resin A-2 was used as a binder resin for the toner particles as well as the pigment master batch.

Example 9

Toner Bk-2

The toner Bk-2 was obtained by the same preparation method as that described in example 4 except that 1 part by weight of the metal complex of salicylic acid represented by the general formula (III) was additionally used.

Example 10

Toner C-12

The toner C-12 was obtained by the same preparation method as that described in example 2 except that (i) the polyester resin A-3 was used as a binder resin, (ii) 5 parts by weight of the oxidized-type low molecular weight polypropylene wax 100 TS (softening point: 140° C.; acid value: 3.5) supplied by Sanyo Chemical Industries, Ltd. and 5 parts by weight of oxidized-type low molecular weight polyethylene wax 4202 E (softening point: 107° C.; acid value: 17) were additionally used, (iii) the mixing time before kneading was set twice, and (iv) the kneading temperature was 210° C.

Example 11 and Comparative Example 7

Toners C-13 and C-14

The toners C-13 and C-14 were obtained by the same preparation method as that described in the comparative example 6 except that the polyester resin A-4 or A-5 was used as a substitute for the polyester resin A-2.

Physical properties of the binder resin and the polymer (B) are shown in Table 1 and 2. Preparing conditions of the toners obtained and their physical properties are shown in Table 3 and 4.

TABLE 1

| Binder resin | | | | | | | | | | | | | | | |
|---|---|---|---|---|---|---|---|---|---|---|---|---|---|---|---|
| Poly-ester resin | H/L (kind) | H/L (weight ratio) | Alcohol component PO | Alcohol component EO | Acid component FA | Acid component TPA | Acid component TMA | Mn | Mw/Mn | Tg (° C.) | Tm (° C.) | Acid value (KOHmg/g) | Hydroxyl value (KOHmg/g) | Insoluble components in THF (wt %) | Grindability index |
| A-1 | L1 | 100 | 4 | 6 | — | 9 | — | 3300 | 4.2 | 68.5 | 110.3 | 3.3 | 28.1 | — | 1.9 |
| A-2 | L2 | 100 | 9 | 1 | — | 8 | — | 1920 | 2.4 | 57.1 | 93.4 | 9.6 | 24.1 | — | 0.6 |

TABLE 1-continued

| Binder resin | | | | | | | | | | | | | | | |
|---|---|---|---|---|---|---|---|---|---|---|---|---|---|---|---|
| Polyester resin | H/L (kind) | H/L (weight ratio) | Alcohol component PO | Alcohol component EO | Acid component FA | Acid component TPA | Acid component TMA | Mn | Mw/Mn | Tg (° C.) | Tm (° C.) | Acid value (KOHmg/g) | Hydroxyl value (KOHmg/g) | Insoluble components in THF (wt %) | Grindability index |
| A-3 | H1 | 60 | 5 | 5 | 7 | — | 5 | 2780 | 31 | 60.2 | 145.8 | 27.9 | 17.6 | 22 | 1.52 |
| | L1 | 40 | 4 | 6 | — | 9 | — | 3300 | 4.2 | 68.5 | 110.3 | 3.3 | 28.1 | — | |
| A-4 | H1 | 60 | 5 | 5 | 7 | — | 5 | 2780 | 31 | 60.2 | 145.8 | 27.9 | 17.6 | 22 | 1.0 |
| | L2 | 40 | 9 | 1 | — | 8 | — | 1920 | 2.4 | 57.1 | 93.4 | 9.6 | 24.1 | — | |
| A-5 | H1 | 10 | 5 | 5 | 7 | — | 5 | 2780 | 31 | 60.2 | 145.8 | 27.9 | 17.6 | 22 | 0.62 |
| | L2 | 90 | 9 | 1 | — | 8 | — | 1920 | 2.4 | 57.1 | 93.4 | 9.6 | 24.1 | — | |

TABLE 2

| Polymer (B) | | | | | | | |
|---|---|---|---|---|---|---|---|
| Sample | Constitutive polymer | Mw | Mn | Mw/Mn | Tg (° C.) | Tm (° C.) | Grindability index |
| B-1 | Polystyrene | 1500 | 1000 | 1.5 | 62 | 120 | 0.3 |
| B-2 | Poly-α-methylstyrene | 2800 | 1500 | 1.9 | 75 | 140 | 0.5 |
| B-3 | Poly-α-methylstyrene | 2400 | 1500 | 1.6 | 72 | 130 | 0.5 |
| B-4 | Isopropenyltoluene-α-methylstyrene-isoprene terpolymer | 1900 | 1100 | 1.7 | 65 | 145 | 0.3 |
| B-5 | Polystyrene | 900 | 650 | 1.4 | 40 | 108 | 0.2 |
| B-6 | Poly-α-methylstyrene | 3100 | 1700 | 1.8 | 88 | 147 | 0.7 |

A value of the glass transition point of the resin was measured by means of a differential scanning calorimeter DSC-200 (manufactured by Seiko Instruments Inc.) under the following condition. A sample (10 mg) was heated from 20° C. to 120° C. with a heating rate of 10° C./min. Alumina was used as a reference. The shoulder value of a main endothermic peak within said temperature range was defined as the glass transition point.

(2) A Measuring Method of a Softening Point of a Resin

The softening point of the resin was measured by means of Flow Tester CFT-500 (manufactured by Shimazu Corporation) under the following condition. The sample (1 $cm^3$) was flown out through a fine hole of a dice (diameter: 1 mm; length: 1 mm) at a pressure of 20 $kg/cm^2$ with a heating rate of 6° C./min. The temperature which corresponds to a half of the height between a starting point of the flow and an end point of the flow was defined as the softening point.

(3) Molecular Weight

The molecular weight was determined according to a polystyrene conversion method by means of gel permeation chromatography 807-IT type (manufactured by Jasco Corporation) using tetrahydrofuran as a carrier solvent.

TABLE 3

| Preparation condition | | | | | Physical properties of the toner | | | | | | | |
|---|---|---|---|---|---|---|---|---|---|---|---|---|
| | | | Polymer B | | | Polymer B | | | | | | |
| Toner | | Polyester resin | Kind | Amount (part by weight) | Dispersion particle size (μm) | Dispersion state | Volume-average particle size (μm) | >2D (wt. %) | <2.5 μm (vol. %) | Mean roundness | Roundness SD | Amount of VOC |
| Y-1 | Ex. 1 | A-1 | B-1 | 5 | 0.4 | Densely on the surface | 6.1 | 0.0 | 0.0 | 0.960 | 0.036 | ◎ |
| C-1 | Ex. 2 | A-1 | B-1 | 5 | 0.3 | Densely on the surface | 6.0 | 0.0 | 0.0 | 0.961 | 0.036 | ◎ |
| C-2 | Ex. 5 | A-1 | B-2 | 5 | 0.3 | Densely on the surface | 6.0 | 0.0 | 0.0 | 0.962 | 0.036 | ○ |
| C-3 | Ex. 6 | A-1 | B-3 | 5 | 0.6 | Densely on the surface | 6.1 | 0.0 | 0.0 | 0.961 | 0.036 | Δ |
| C-4 | Ex. 7 | A-1 | B-4 | 5 | 0.1 | Densely on the surface | 6.0 | 0.0 | 0.0 | 0.961 | 0.036 | ◎ |
| C-5 | Com. ex. 1 | A-1 | B-5 | 5 | 0.05> | Wholly distributed | 6.0 | 0.1 | 2.0 | 0.943 | 0.046 | X |
| C-6 | Com. ex. 2 | A-1 | B-6 | 5 | 1.6 | Wholly distributed | 6.2 | 0.5 | 0.8 | 0.957 | 0.042 | Δ |
| C-7 | Com. ex. 3 | A-1 | B-1 | 0 | — | — | 6.2 | 0.3 | 2.2 | 0.952 | 0.042 | — |
| C-8 | Com. ex. 4 | A-1 | B-1 | 1 | 0.05> | Wholly distributed | 6.1 | 0.2 | 2.0 | 0.952 | 0.041 | ◎ |
| C-9 | Ex. 8 | A-1 | B-1 | 10 | 1.1 | Densely on the surface | 6.1 | 0.0 | 0.0 | 0.960 | 0.037 | ◎ |
| C-10 | Com. ex. 5 | A-1 | B-1 | 20 | 1.6 | Wholly distributed | 6.0 | 0.0 | 0.6 | 0.958 | 0.039 | Δ |
| C-11 | Com. ex. 6 | A-2 | B-1 | 5 | 0.8 | Wholly distributed | 5.9 | 0.0 | 1.2 | 0.957 | 0.040 | ◎ |
| C-12 | Ex. 10 | A-3 | B-1 | 5 | 0.7 | Densely on the surface | 5.8 | 0.0 | 0.0 | 0.963 | 0.034 | ◎ |
| C-13 | Ex. 11 | A-4 | B-1 | 5 | 0.5 | Densely on the surface | 5.9 | 0.0 | 0.0 | 0.960 | 0.037 | ◎ |
| C-14 | Com. ex. 7 | A-5 | B-1 | 5 | 0.8 | Wholly distributed | 5.8 | 0.0 | 2.0 | 0.954 | 0.041 | ◎ |
| M-1 | Ex. 3 | A-1 | B-1 | 5 | 0.3 | Densely on the surface | 6.0 | 0.0 | 0.0 | 0.961 | 0.037 | ◎ |
| Bk-1 | Ex. 4 | A-1 | B-1 | 5 | 0.08 | Densely on the surface | 6.1 | 0.0 | 0.0 | 0.961 | 0.036 | ◎ |
| Bk-2 | Ex. 9 | A-1 | B-1 | 5 | 0.1 | Densely on the surface | 6.1 | 0.0 | 0.0 | 0.961 | 0.037 | ◎ |

Measuring Methods (1) A Measuring Method of a Glass Transition Point (Tg) of a Resin (4) Acid Value A sample (10 mg) was dissolved in toluene (50 ml), and this solution was titrated by a standardized solution of N/10 potassium hydroxide/alcohol in the presence of a mixed indicator of 0.1% of bromothymol blue and phenol red. The acid value was calculated from the amount of consumption of the solution of N/10 potassium hydroxide/alcohol.

(5) Hydroxyl Value

A weighed sample was treated with acetic anhydride, and the acetyl compound obtained was subjected to a hydrolysis. The hydroxyl value is the number of mg of potassium hydroxide required for neutralizing the isolated acetic acid.

(6) Insoluble Components in Tetrahydrofuran (THF)

A resin [5 g(X)] was added to tetrahydrofuran (100 g; 25° C.), and the mixture was agitated for 24 hours, and then the resultant solution was subjected to a filtration under pressure. The residual material on the filter paper was dried and weighed. The insoluble components in THF was calculated by the following equation:

$$\text{The insoluble components}(\%) = \frac{\text{A weight of the residual material}}{X} \times 100$$

(7) Grindability Index

A binder resin, a polymer (B) or a toner composition (said composition was prepared by kneading its components and by coarsely grinding the cooled kneaded product by means of Feather Mill having a mesh size of 2 mm) having a volume-average particle size of about 2 mm was used as a sample. At the time when the sample is ground by means of the mechanical grinder KTM-0 type (manufactured by Kawasaki Heavy Industries Ltd.) under the condition that the treating rate (F) was 5 kg/h and the number of KTM revolutions was 12000 rpm, the load power value at the time of passing no sample ($W_0$) and the load power value at the time of passing the sample ($W_1$) were recorded. Then the volume-average particle size D ($\mu$m) of the KTM ground sample was measured by means of Coulter Multisizer II (manufactured by Beckman Coulter Inc.). Based on the obtained values, the grindability index of the sample was calculated by the following equation:

$$\text{Grindability index}=[D\times(W_1-W_0)]/F$$

(8) Dispersion Particle Size and Dispersion State of a Polymer (B)

In each example and comparative example, the coarsely ground toner particles having a volume-average particle size of about 2 mm, which were prepared by coarsely grinding the kneaded product after cooling by means of Feather Mill having a mesh size of 2 mm, were sliced with a microtome, and the sliced sample was stained with the osmium compound, and then a microscopic photograph (10000 magnifications) of the sliced sample was taken by means of TEM (transmission electron microscope). The photographic images were taken in an image analyzer LUZEX 5000 (manufactured by Nireco Corporation), and a distribution of particle size was measured by observing the dispersion state of the polymer (B) in the particles. In the case where a shape of the dispersed particles is not a perfect sphere, a particle size which corresponds to a sectional circle of the dispersed particle was calculated.

The dispersion state of the polymer (B) in the toner particles obtained after the classification was observed by the same manner as that described above. With respect to the dispersion state shown in Table 3, the case where the polymer (B) is more densely dispersed in the surface layer part of the particles in comparison with the central part of the particles is referred to as "densely on the surface", and the case where the polymer (B) is uniformly distributed in the particles is referred to as "wholly distributed".

(9) A Volume-average Particle Size of the Toner

The volume-average particle size (D) of the toner, a content of the toner particles having a volume-average particle size of not less than 2 D and a content of the toner particles having a volume-average particle size of not more than 2.5 $\mu$m were measured by means of Coulter Multisizer II (manufactured by Beckman Coulter) using an aperture tube (50 $\mu$m).

(10) A Roundness of the Toner

The roundness is represented by "circumferential length of a corresponding circle/circumferential length of a projected image of a particle". A mean roundness was measured by means of a flow-type particle image analyzer FPIA-2000 (manufactured by Sysmex Corporation) using an aqueous dispersion system. In addition, a standard deviation of the roundness (roundness SD) was analyzed.

(11) A Yield of the Toner

The total weight of the toner materials used and the weight of the toner obtained were measured. The yield of the toner is calculated by the following equation:

$$\text{Yield}\ (\%) = \frac{\text{Weight of the toner obtained}}{\text{Total weight of the toner materials}} \times 100$$

(12) Volatile Components (VOC)

Contents of the volatile components included in an amount of the polymer (B) used was measured by means of headspace gas chromatography. Acetone, benzene, toluene and residual monomers were detected as VOC. The following items were evaluated, and the worst evaluation result was shown in Table 3.

i) Total Amount of VOC

◎: ≦400 ppm

○: 400–700 ppm

Δ: 700–1000 ppm

×: 1000 ppm ≦ ii) Acetone

◎: ≦1 ppm

○: 1–3 ppm

Δ: 3–5 ppm

×: 5 ppm ≦ iii) Benzene

◎: undetectable

×: detectable

Various items described below were evaluated, and the evaluation results are shown in Table 4.

TABLE 4

| Evaluation as one-component |
|---|

| Toner | | Yield of toner (wt. %) | Grind-ability index | Main-tenance of heat resistance | Electri-fication amount: Initial stage | Electri-fication amount: 1000 sheets printing | Adhe-sive state | Evaluation as two-components: Rising property of electri-fication | Electri-fication stability | Fog-ging | Repro-ducibility of dots | Reprodu-cibility of fine lines | Light trans-mission for OHP | Fixing strength | Smear-preven-tive property |
|---|---|---|---|---|---|---|---|---|---|---|---|---|---|---|---|
| Y-1 | Ex. 1 | 81 | 0.9 | ○ | 28 | 26 | (1) | ○ | ○ | ○ | ○ | ○ | ○ | ○ | ○ |
| C-1 | Ex. 2 | 81 | 0.9 | ○ | 27 | 25 | (1) | ○ | ○ | ○ | ○ | ○ | ○ | ○ | ○ |
| C-2 | Ex. 5 | 80 | 1.0 | ○ | 28 | 26 | (1) | ○ | ○ | ○ | ○ | ○ | ○ | ○ | ○ |
| C-3 | Ex. 6 | 81 | 1.1 | ○ | 28 | 26 | (1) | ○ | ○ | ○ | ○ | ○ | ○ | ○ | ○ |
| C-4 | Ex. 7 | 80 | 0.8 | ○ | 29 | 26 | (1) | ○ | ○ | ○ | ○ | ○ | ○ | ○ | ○ |
| C-5 | Com. ex. 1 | 65 | 0.7 | X | 25 | 10 | (2) | X | X | X | Δ | Δ | ○ | ○ | ○ |
| C-6 | Com. ex. 2 | 63 | 1.3 | ○ | 27 | 13 | (2) | Δ | Δ | X | Δ | Δ | X | ○ | ○ |
| C-7 | Com. ex. 3 | 48 | 1.8 | ○ | 25 | 18 | (1) | Δ | ○ | ○ | ○ | ○ | ○ | ○ | ○ |
| C-8 | Com. ex. 4 | 49 | 1.6 | ○ | 26 | 19 | (1) | Δ | ○ | ○ | ○ | ○ | ○ | ○ | ○ |
| C-9 | Ex. 8 | 80 | 0.7 | ○ | 28 | 26 | (1) | ○ | ○ | ○ | ○ | ○ | ○ | ○ | ○ |
| C-10 | Com. ex. 5 | 77 | 0.5 | Δ | 28 | 13 | (2) | X | X | X | X | X | Δ | X | X |
| C-11 | Com. ex. 6 | 72 | 0.4 | X | 28 | 15 | (2) | Δ | Δ | X | Δ | Δ | ○ | Δ | X |
| C-12 | Ex. 10 | 82 | 0.7 | ○ | 29 | 27 | (1) | ○ | ○ | ○ | ○ | ○ | Δ | ○ | ○ |
| C-13 | Ex. 11 | 80 | 0.6 | ○ | 29 | 27 | (1) | ○ | ○ | ○ | ○ | ○ | Δ | ○ | ○ |
| C-14 | Com. ex. 7 | 62 | 0.4 | X | 28 | 12 | (2) | Δ | Δ | X | X | X | X | Δ | X |
| M-1 | Ex. 3 | 81 | 0.9 | ○ | 28 | 26 | (1) | ○ | ○ | ○ | ○ | ○ | ○ | ○ | ○ |
| Bk-1 | Ex. 4 | 81 | 0.8 | ○ | 29 | 28 | (1) | ○ | ○ | ○ | ○ | ○ | — | ○ | ○ |
| Bk-2 | Ex. 9 | 82 | 0.8 | ○ | 29 | 27 | (1) | ○ | ○ | ○ | ○ | ○ | — | ○ | ○ |

(1) no adhesion
(2) adhesion occurred

Maintenance of Heat Resistance

The weighed toner (10 g) was charged into a screw tube made of glass (100 cc), and the screw tube was left as it was at 60° C. for 5 hours, and then a cohesive state of the toner was ranked according to the following standard.

○: Cohered toner was not found, and a practical problem was not brought about.

Δ: Although a weakly cohered mass was found, it was gotten loose immediately with a weak force, and a practical problem was not brought about.

×: A strongly cohered mass was found, and said mass was not easily gotten loose, and a practical problem was brought about.

Evaluation as One-component Developer

Electrification Amount and an Adhesive State

Each toner was charged into a toner cartridge of a printer (INTERCOLOR LP 3000C manufactured by Seiko Epson Inc.), and an image (BW ratio: 6%) was printed on 1000 sheets. Electrification amount of the toner was measured by an aspiration method at an initial stage and after the printing of 1000 sheets. In addition, the adhesive state of the toner on the surface of a regulating blade was observed after the printing of 1000 sheets.

Evaluation as Two-components Developer (1) Preparation of a Binder-type Carrier

In order to subject the toners prepared in the aforementioned examples and comparative examples to the evaluation as two-components developer, the binder-type carrier was prepared by the following method.

Polyester resin NE-1110 (made by Kao Inc.)(100 parts by weight), magnetic particles Magnetite EPT-1000 (made by Toda Kogyo Inc.)(700 parts by weight) and carbon black MOGUL L (made by Cabot Corporation)(2 parts by weight) were sufficiently mixed by means of Henschel Mixer. The mixture was melted and kneaded by means of a twin-screw extruding kneader wherein a cylinder section and a cylinder head section were set at 180° C. and 170° C. respectively. The kneaded product was cooled, coarsely ground by means of a hammer mill, finely ground by means of a jet mill, and then classified to obtain the binder-type carrier having a volume-average particle size of 40 μm. The particle size of the carrier was measured by means of Coulter Multisizer II (manufactured by Beckman Coulter) using an aperture tube (150 μm).

In the case where the toner was evaluated as two-components developer, H-2000 (made by Clariant Inc.)(0.5 part by weight) was employed in each toner as a substitute for the hydrophobic silica TS-500 (made by Cabot Corporation) which was used in the post-treatment (0.5 part by weight). Other post-treating agents were same as those used in the toner as one-component developer.

(2) Rising Property of Electrification and Electrification Stability

In order to evaluate the rising property of electrification of two-components developer, the toner was blended with the carrier (toner mixing ratio: 14% by weight), a quantity of charge during 1 minute, 5 minutes or 30 minutes was measured by an electrolytic separation method.

Independently of this measurement, the following measurement was carried out in order to evaluate an electrification stability for the duration of use. The toner was blended with the carrier (toner mixing ratio: 14% by weight), and the both components were mixed by using a trestle for 12 hours, and then the toner was electrolyticly separated from the carrier. After that, the toner was blended with the carrier which was separated (toner mixing ratio: 7% by weight), and a quantity of charge during 1 minute, 5 minutes or 30 minutes was measured by the electrolytic separation method.

On the basis of the data obtained, the rising property of electrification and the durability (electrification stability)

were ranked according to the following standard which standardizes whether they are on a practically usable level.

◎: Excellent.

○: A practical problem was not brought about.

Δ: A practical problem was brought about under a specific use condition.

×: A practical problem was brought about.

In the following evaluations (3)–(6), a digital copying machine DiALTA Di350 (manufactured by Minolta Co., Ltd.) was employed.

(3) Fogging

A starter was prepared by mixing each toner and the aforementioned binder-type carrier in such a way that the toner mixing ratio was 7% by weight. Each starter was loaded into the copying machine, and a durability test was carried out by printing an image (B/W: 7%) on 3000 sheets under the circumstances of 25° C. and 55%RH.

The fogging was ranked according to the following standard.

○: The fogging did not occur at all, and a deterioration of an image quality was not observed.

Δ: The fogging hardly occurred, and a deterioration of an image quality was hardly observed. A practical problem was brought about.

×: The fogging occurred, and a deterioration of an image was observed.

(4) Image Quality (Reproducibility of Dots, Reproducibility of Fine Lines and Light Transmission for OHP)

Each toner was blended with the aforementioned binder-type carrier in such a way that the toner mixing ratio was 7% by weight. A starter was prepared by mixing said blend for 30 minutes with a trestle. Each starter was loaded into the copying machine. The reproducibilities of dots and fine lines were evaluated by printing out an image. At the same time, a monochromatic light transmission was evaluated by using OHP. These characteristics were ranked according to the following standard.

○: The image quality was excellent.

Δ: The image quality was on a level which did not bring about a practical problem.

×: The image quality was deteriorative, and a practical problem was brought about.

(5) Fixing Strength

An image was taken by means of a fixing apparatus which was remodelled in such a manner that a temperature of a fixing roller can be changed at intervals of 2° C. The image was folded double in the middle, and a releasability of the image was visually evaluated. It is unpermissible that the image was peeled off to a peripheral region of the folded part, and it is permissible that only the folded part of the image was peeled off. A lower limit of the fixing temperature which brings about the permissible state of the image was ranked according to the following standard.

○: Less than 150° C.

Δ: Not less than 150° C. and less than 165° C.

Δ: Not less than 165° C.

The image used in the above evaluation was a solid gradation pattern (1.5 cm×1.5 cm) and was adjusted in such a way that the maximum amount of the adhered toner was 1.5 mg/cm$^2$.

(6) Smear-preventive Property

Each sample was fixed on a sheet, and the fixed sheet and another unused sheet were rubbed together. A stained state of the unused sheet was observed, and was ranked according to the following standard.

○: The stain was hardly conspicuous.

Δ: Although a slight stain was observed, a practical problem did not occur.

×: The stain was observed on the whole surface, and a practical problem was brought about.

The toner according to the present invention has excellent rising property of electrification, electrification stability, maintenance of heat resistance, fixability, image quality and productivity. The toner of the present invention has relatively high roundness and uniform shape and is applicable to full-color image formation, cleanerless system and toner-recycling system.

What is claimed is:

1. A toner for developing an electrostatic image which comprises toner particles containing a binder resin (A), a polymer (B) and a colorant, the polymer (B) having weight-average molecular weight of 1000–3000 and having a ratio of weight-average molecular weight/number-average molecular weight being not more than 2, wherein polymer (B) particles are more densely dispersed in surface regions of the toner particles in comparison with central parts of the toner particles.

2. A toner of claim 1, wherein a dispersion particle size of the polymer (B) particles is 0.05–2.5 μm.

3. A toner of claim 1, wherein the polymer (B) is incompatible with the binder resin (A).

4. A toner of claim 3, wherein the polymer (B) is a homopolymer or a copolymer of an aromatic monomer and/or an aliphatic monomer.

5. A toner of claim 4, wherein (i) the aromatic monomer is a monomer selected from a class consisting of styrene, vinyltoluene, α-methylstyrene, isopropenyltoluene and indene, and (ii) the aliphatic monomer is a monomer selected from a class consisting of isoprene, piperylene, 2-methyl butene-1 and 2-methyl butene-2.

6. A toner of claim 4, wherein the polymer (B) is polystyrene having weight-average molecular weight of 1000–2000.

7. A toner of claim 4, wherein the polymer (B) is poly-α-methylstyrene having weight-average molecular weight of 2000–2800.

8. A toner of claim 1, wherein the polymer (B) has a glass transition point of 55–85° C. and a softening point of 110–150° C.

9. A toner of claim 1, wherein the binder resin (A) is polyester resin.

10. A toner of claim 1, wherein the polymer (B) has a grindability index of 0.1–1.0, said grindability index being defined as follows:

$$\text{Grindability index}=[D\times(W_1-W_0)]/F$$

wherein D is a volume-average particle size (μm) of the polymer (B) which is ground by a mechanical grinder, F is a treating rate (kg/h) of the polymer (B) by the mechanical grinder, $W_0$ is a load-power value of the mechanical grinder at the time of passing no polymer (B), and $W_1$ is a load-power value of the mechanical grinder at the time of passing the polymer (B).

11. A toner for developing an electrostatic image which comprises toner particles containing a binder resin (A), a polymer (B) and a colorant, the polymer (B) having weight-average molecular weight of 1000–3000 and having a ratio of weight-average molecular weight/number-average molecular weight being not more than 2, wherein a content of the polymer (B) is 2–15 parts by weight in relations to 100 parts by weight of the binder resin (A), and polymer (B) particles having average dispersion particle size of 0.08–1.5 μm are dispersed in the toner particles having volume-average particle size of 5–8 μm, wherein the polymer (B) paricles are more densely dispersed in surface regions of the toner particles in comparison with central parts of the toner particles.

12. A toner of claim 11, wherein the average dispersion particle size of the polymer (B) is 0.1–1.5 $\mu$m.

13. A toner of claim 13, wherein the content of the polymer (B) is 2.5–10 parts by weight in relations to 100 parts by weight of the binder resin (A).

14. A toner of claim 11, wherein it comprises a wax, and a content of the wax is 2–20 parts by weight in relations to 100 parts by weight of the binder resin (A).

15. A toner of claim 14, wherein the wax comprises two kinds of waxes having different melting points, the difference of the melting points between the two kinds of waxes being not less than 20° C.

16. A toner of claim 15, wherein the wax comprises a polyethylene wax as the low melting point wax and a polypropylene wax as the high melting point wax.

17. A toner of claim 11, the binder resin (A) is polyester resin.

18. A toner of claim 11, wherein the polymer (B) is a homopolymer or a copolymer of an aromatic monomer and/or an aliphatic monomer.

19. A toner of claim 18, wherein (i) the aromatic monomer is a monomer selected from a class consisting of styrene, vinyltoluene, α-methylstyrene, isopropenyltoluene and indene, and (ii) the aliphatic monomer is a monomer selected from a class consisting of isoprene, piperylene, 2-methyl butene-1 and 2-methyl butene-2.

20. A toner of claim 11, wherein the polymer (B) has a grindability index of 0.1–1.0, said grindability index being defined as follows:

$$\text{Grindability index}=[D\times(W_1-W_0)]/F$$

wherein D is a volume-average particle size ($\mu$m) of the polymer (B) which is ground by a mechanical grinder, F is a treating rate (kg/h) of the polymer (B) by the mechanical grinder, $W_0$ is a load-power value of the mechanical grinder at the time of passing no polymer (B), and $W_1$ is a load-power value of the mechanical grinder at the time of passing the polymer (B).

* * * * *